US005157879A

United States Patent [19]

Fletcher

[11] Patent Number: 5,157,879

[45] Date of Patent: Oct. 27, 1992

[54] BROADHEAD ARROW SHARPENER

[75] Inventor: William J. Fletcher, Santa Ana, Calif.

[73] Assignee: Fletcher Engineering, Inc., Westminster, Calif.

[21] Appl. No.: 524,354

[22] Filed: May 16, 1990

[51] Int. Cl.[5] ..... B24D 15/06

[52] U.S. Cl. ..... 51/285; 51/214; 51/181 R; 76/86; 76/88

[58] Field of Search ..... 51/181 R, 211 R, 211 H, 51/212-214, 204, 205 R, 205 WG, 285, 391, 392, 158, 354; 76/82, 86, 88, 81.8

[56] References Cited

U.S. PATENT DOCUMENTS

| | | | |
|---|---|---|---|
| 53,645 | 7/1919 | Taylor | 425/408 |
| 137,763 | 4/1973 | Daniels | 51/205 |
| 151,323 | 10/1948 | Chapin et al. | D37/1 |
| 194,417 | 5/1977 | Davis | 83/762 |
| 211,107 | 5/1968 | Theobald et al. | D37/1 |
| 211,261 | 6/1968 | Theobald et al. | D37/1 |
| 211,262 | 6/1968 | Theobald et al. | D37/1 |
| 219,726 | 1/1971 | van Horn | D8/2 |
| 241,504 | 9/1976 | Krusche et al. | D8/93 |
| 260,356 | 8/1981 | Hall | 474/105 |
| 276,886 | 12/1984 | Carter | D8/93 |
| 277,166 | 1/1985 | Call | D8/93 |
| 280,380 | 9/1985 | Graves | D8/91 |
| 287,222 | 12/1986 | Cooley et al. | 256/1 |
| 555,819 | 3/1896 | Johnston | 51/181 R |
| 572,190 | 12/1896 | Brinkman | 76/86 |
| 612,912 | 10/1898 | Poindexter | 76/88 |
| 833,499 | 10/1906 | Baries | 76/88 |
| 1,059,491 | 4/1913 | Schwartz | 51/214 |
| 1,324,512 | 12/1919 | Maurer | 76/86 |
| 1,438,052 | 12/1922 | Nichols | 76/88 |
| 1,540,078 | 6/1925 | Long | 51/158 |
| 1,608,841 | 11/1926 | DeCanio | 51/158 |
| 1,803,364 | 5/1931 | Stephens | 51/158 |
| 2,047,439 | 7/1936 | Skevington | 76/88 |
| 2,116,582 | 5/1938 | Muelberger, Jr. | 51/214 |
| 2,160,979 | 6/1939 | Moeller | 51/214 |
| 2,238,340 | 4/1941 | Poe | 120/89 |
| 2,473,702 | 6/1949 | Carlin | 51/214 |
| 2,559,273 | 7/1951 | Brinkley | 76/88 |
| 2,743,561 | 5/1956 | Franks | 51/214 |
| 2,798,344 | 7/1957 | Hertel | 51/211 |
| 3,052,068 | 9/1962 | Burgess | 51/59 |
| 3,623,280 | 11/1971 | Chesnut | 51/370 |
| 3,733,933 | 5/1973 | Longbrake | 76/88 |
| 3,797,334 | 3/1974 | Sinclair | 76/88 |
| 3,800,632 | 4/1974 | Juranitch | 76/82 |
| 3,819,170 | 6/1974 | Longbrake | 269/3 |
| 4,078,455 | 3/1978 | Brody | 76/88 |
| 4,228,703 | 10/1980 | Moss | 76/86 |
| 4,494,340 | 1/1985 | Carter | 51/214 |
| 4,530,188 | 7/1985 | Graves | 51/205 WG |
| 4,696,129 | 9/1987 | Roberts | 51/214 |
| 4,747,235 | 5/1988 | Priebe | 51/211 R |
| 4,835,910 | 6/1989 | Roberts | 51/285 |

FOREIGN PATENT DOCUMENTS

| | | | |
|---|---|---|---|
| 0013232 | 7/1894 | United Kingdom | 76/88 |
| 0380649 | 9/1932 | United Kingdom | 51/211 H |
| 0662781 | 12/1951 | United Kingdom . | |
| 2026909 | 2/1980 | United Kingdom . | |

*Primary Examiner*—Robert A. Rose
*Attorney, Agent, or Firm*—Knobbe, Martens, Olson & Bear

[57] ABSTRACT

A device particularly suited for sharpening broadhead arrows and having sharpening surfaces which are curved in the direction the broadhead travels as it is sharpened. In a preferred embodiment, the sharpener comprises two sharpening surfaces to sharpen broadhead arrows and a third cylindrical sharpening surface which can be used to sharpen other discrete cutting elements. Each broadhead sharpening surface is formed as two sections which are curved about an axis perpendicular to the direction of travel of the arrow blades so that only one line of contact is formed between a blade and its respective sharpening section, resulting in even sharpening along all the points on a blade.

17 Claims, 3 Drawing Sheets

Fig. 3
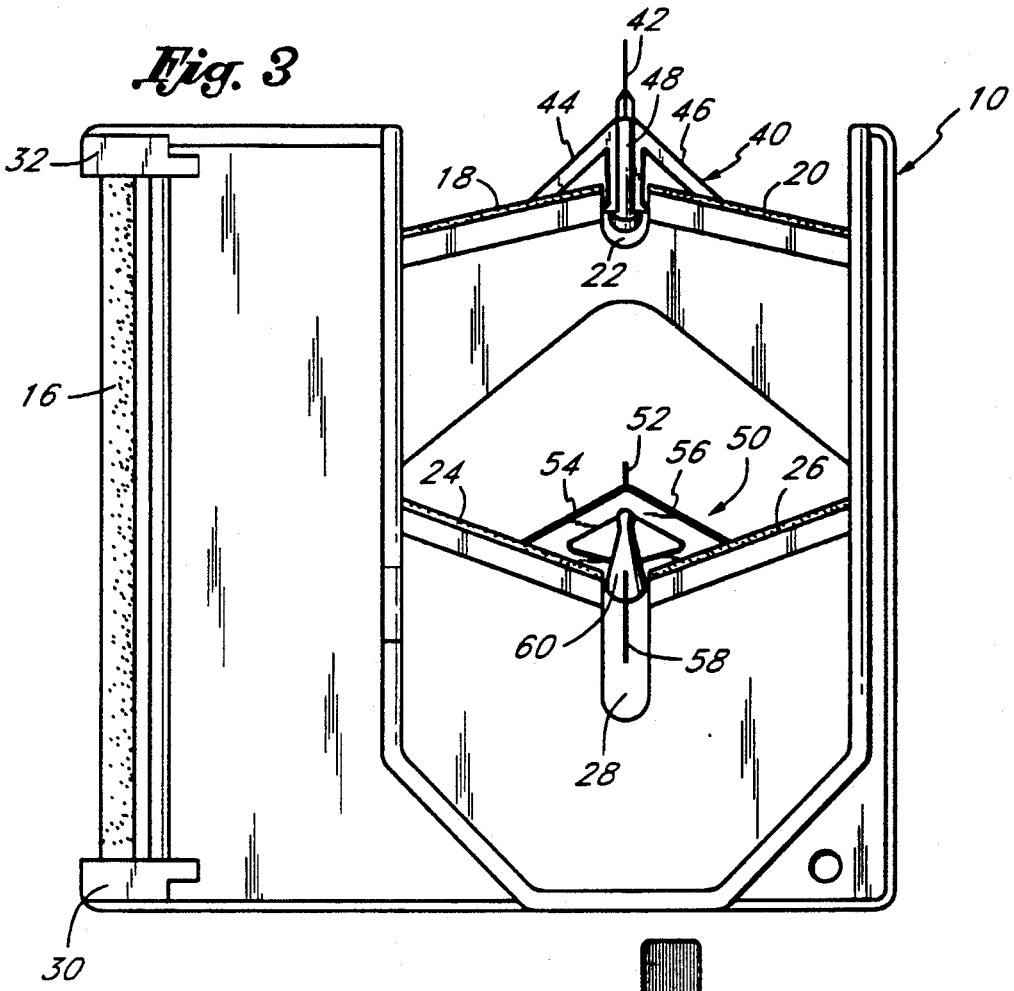
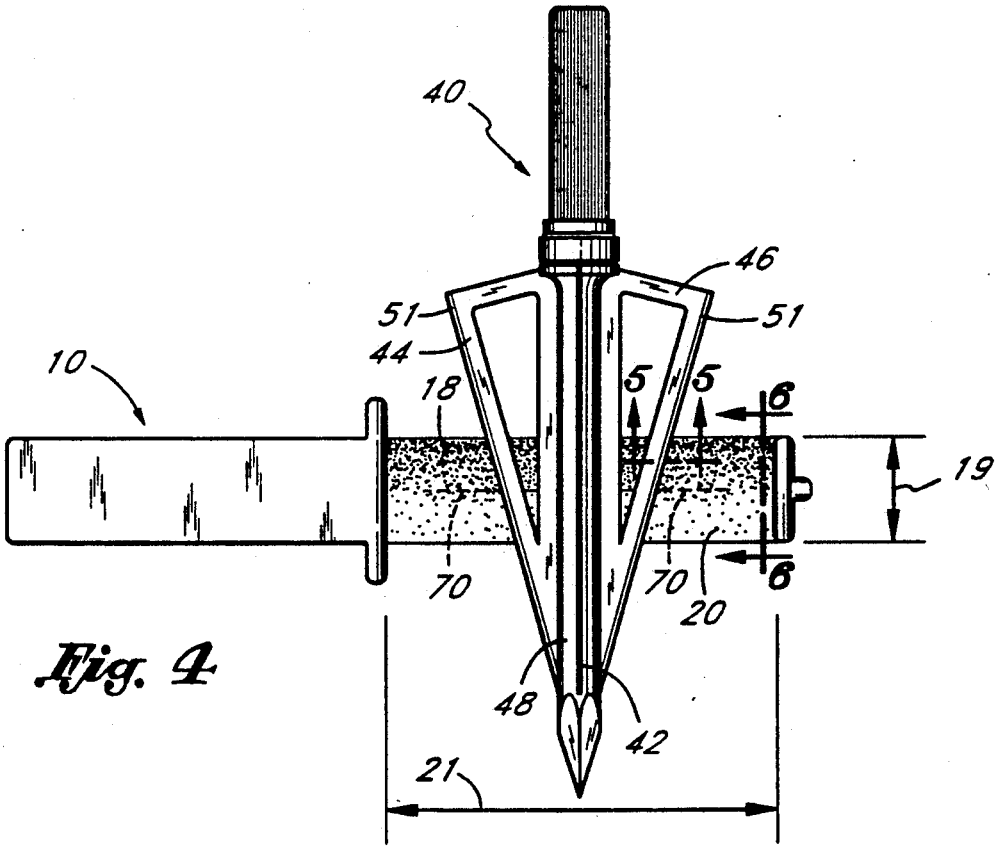
Fig. 4

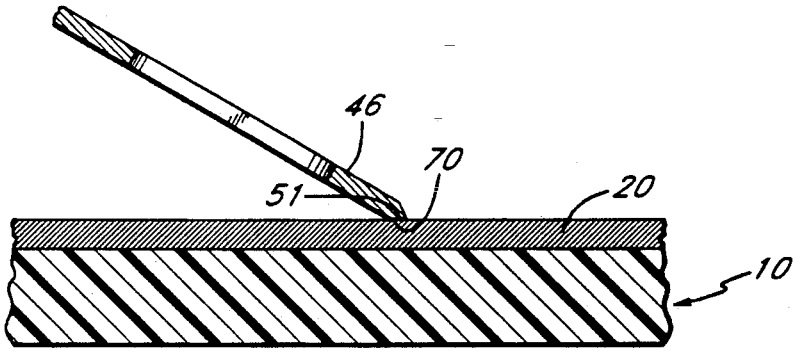
Fig. 5
Fig. 6
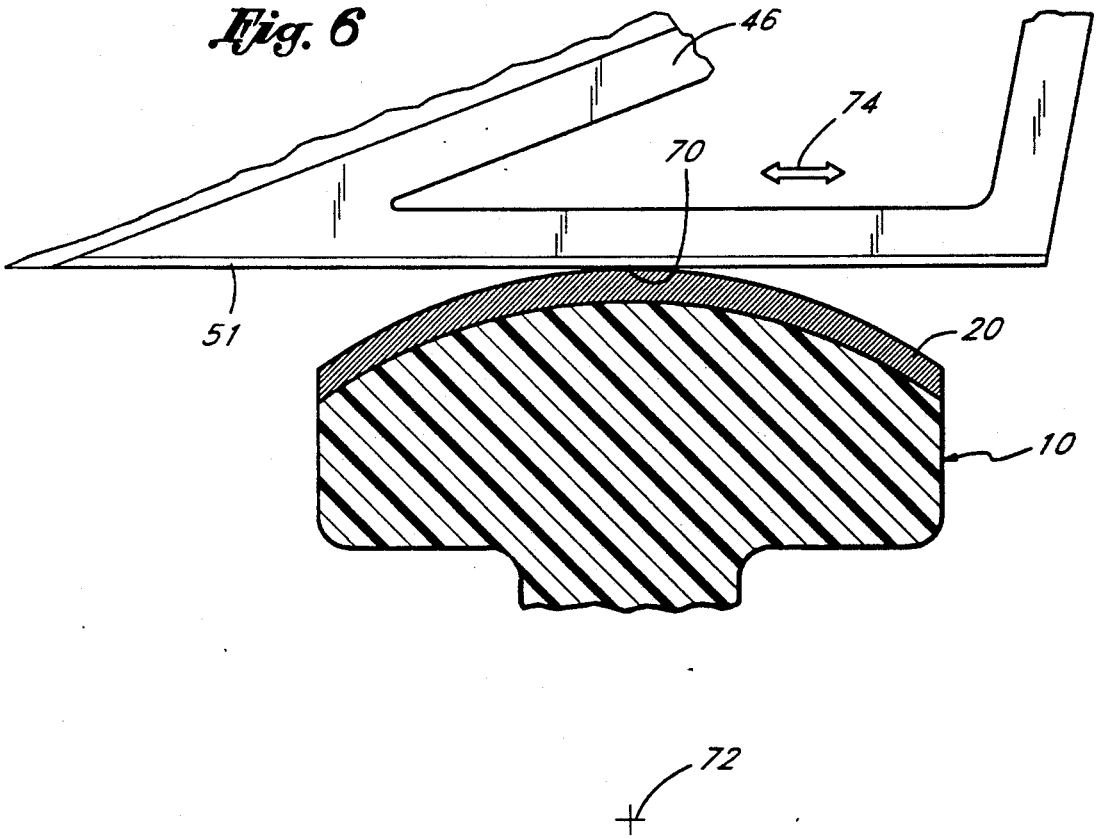

BROADHEAD ARROW SHARPENER

FIELD OF THE INVENTION

The present invention generally relates to sharpeners, and, in particular, to sharpeners which can be used to sharpen broadhead arrows and other cutting elements.

BACKGROUND OF THE INVENTION

Sharpness of the cutting edge is an essential factor for arrowheads, fishhooks, and the like. For broadhead arrows, it is necessary that the blades be razor sharp so as to effectively sever the arteries and blood vessels in the game, resulting in a quick, clean kill. Once used in practice or hunting, the blades become dulled and must be repeatedly sharpened to maintain their effectiveness. Hand-held sharpeners have been developed for this purpose to be used by the hunter in the field.

Typically, sharpeners for broadhead arrows comprise more than one sharpening surface so that two or more blades can be sharpened at the same time. The sharpener is usually divided into two sections having a groove formed therebetween. One difficulty commonly associated with such sharpeners is obtaining correct placement of the blade with respect to the surface so that each point on the blade is sharpened to the same degree. It is nearly impossible to achieve even sharpening in these configurations since the arrowhead can not be held perfectly flat with respect to the sharpening surface. This causes the amount of force applied to be unevenly distributed along the surface area of the blade contacting the sharpening surface. As a result, some points along the blade are sharpened to a greater degree than other points. Consequently, the overall sharpness of the blade is uneven and performance of the broadhead is less than optimum.

SUMMARY OF THE INVENTION

The present invention provides a sharpening device which can be utilized to sharpen a variety of cutting elements. The sharpener is particularly suited to sharpen broadhead arrows and can be used with such arrows having a plurality of broadhead blades. The sharpener provides a single line of contact by utilizing sharpening surfaces which are curved about an axis perpendicular to the direction the blade travels as it is sharpened. This achieves even sharpening of the blades along the length of the cutting edge. Furthermore, the sharpener of the present invention allows the line of contact between the blade and the sharpening surface to move along the entire curvature of the sharpening surfaces, thus reducing wear and increasing the durability of the device.

BRIEF DESCRIPTION OF THE DRAWINGS

FIG. 3 is an elevation view of the device illustrating the sharpening process;

FIG. 4 is a top plan view of the process shown in FIG. 3;

FIG. 5 is a front partial cross-sectional view taken along line 5—5 of FIG. 4;

FIG. 6 is a side partial cross-sectional view taken along line 6—6 of FIG. 4.

DETAILED DESCRIPTION OF THE INVENTION

Figure 1:
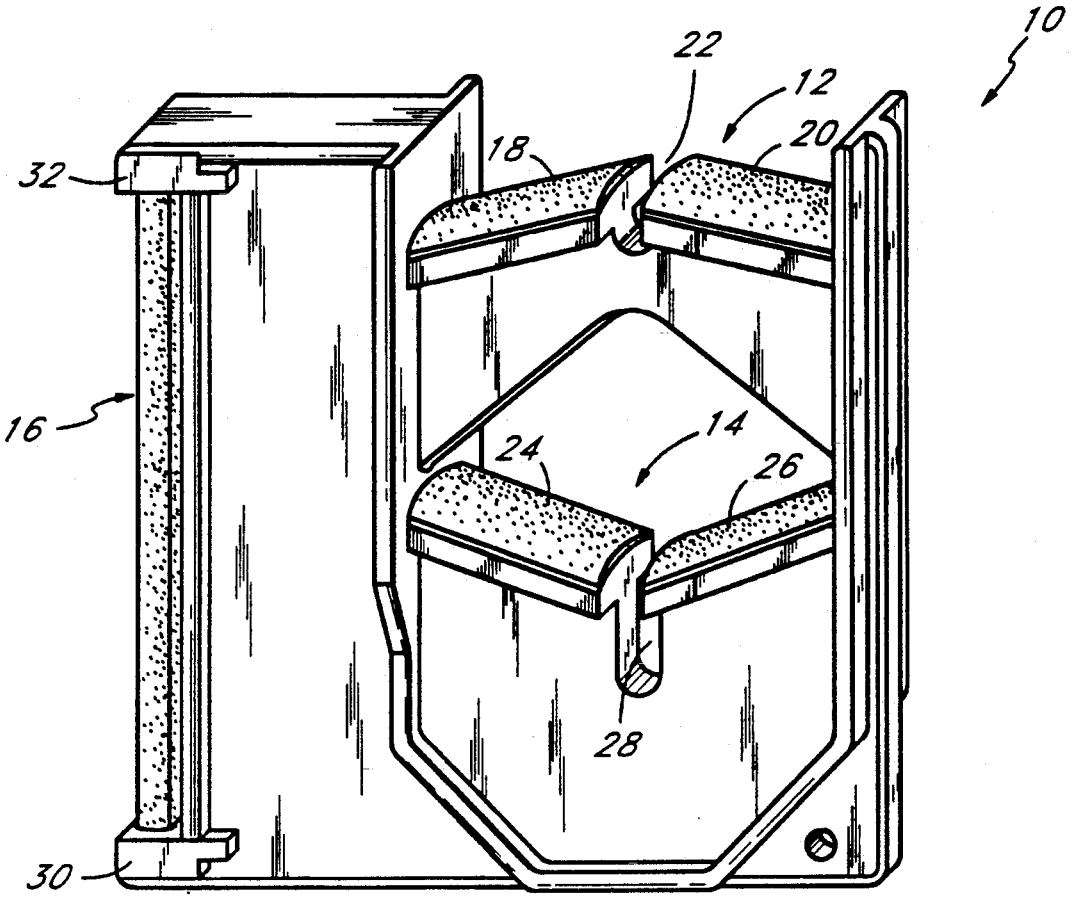
FIG. 1 is a perspective view of the sharpening device of the preset invention.

As shown in FIG. 1, the sharpener of the present invention comprises a frame 10 having top and bottom sharpening surfaces 12, 14 which are particularly suited to sharpen broadhead arrow blades. An additional cylindrical sharpening surface 16 is located at one side of the frame 10 and can be used to sharpen knives, fishhooks, serrated broadheads, serrated knives, or other types of cutting elements. The top sharpening surface 12 includes two sections 18, 20 which are angled downwardly. The top sections 18, 20 form a gable and have a slot or groove 22 formed in the frame 10 therebetween. The bottom sharpening surface 14 comprises two sections 24, 26 angled upwardly in a "V" configuration. A slot or channel 28 is formed in the frame 10 between the bottom sharpening sections 24, 26. Each section 18, 20, 24, 26 is curved about an axis perpendicular to the direction of blade travel as will be explained hereinafter. The cylindrical sharpening surface 16 extends between a pair of projections 30, 32 at one side of the frame 10 as shown.

In this illustrative embodiment, the sharpening sections 18, 20, 24, 26, are formed as a part of a frame 10 molded of ABS plastic and covered with diamond pads to provide the appropriate abrasive surface which will sharpen blades of a broadhead arrow. The diamond pads are formed of sheet metal which is cut or stamped to fit the sharpening sections 18, 20, 24, 26. Abrasive diamond particles are then bonded to the surface of the metal in a bonding process such as that disclosed by J. Lawrence Fletcher in U.S. Pat. No. 4,079,552 entitled "Diamond Bonding Process" and U.S. Pat. No. 4,155,721 entitled "Bonding Process for Grinding Tools", and incorporated herein by reference. In addition, the cylindrical sharpening surface 16 is also formed of diamond particles which are bonded to sheet metal to effect sharpening of other types of cutting elements. One skilled in the art will recognize, however, that a variety of substances can be used to form the frame 10 and sharpening surfaces 12, 14, 16. In the preferred embodiment, the frame 10 is approximately 2.75 inches high and 3.18 inches wide so as to be easily held in one hand and able to be inserted in a pocket. The groove 22 is approximately 0.16 inches wide. The channel 28 is approximately 0.56 inches in depth and has a width of approximately 0.12 inches. The top sharpening sections 18, 20 are angled downwardly at approximately 12 degrees from the horizontal while the bottom sharpening sections 24, 26 are angled upwardly at approximately 18 degrees from the horizontal. The 18 degree angle has been chosen in accordance with the standard manufacturing angle for broadhead blades, although, one skilled in the art will recognize that this angle may be varied to reflect broadheads with blades at lesser or greater angles. The width of each sharpening section 18, 20, 24, 26 is preferably 0.4 inches.

Figure 2:
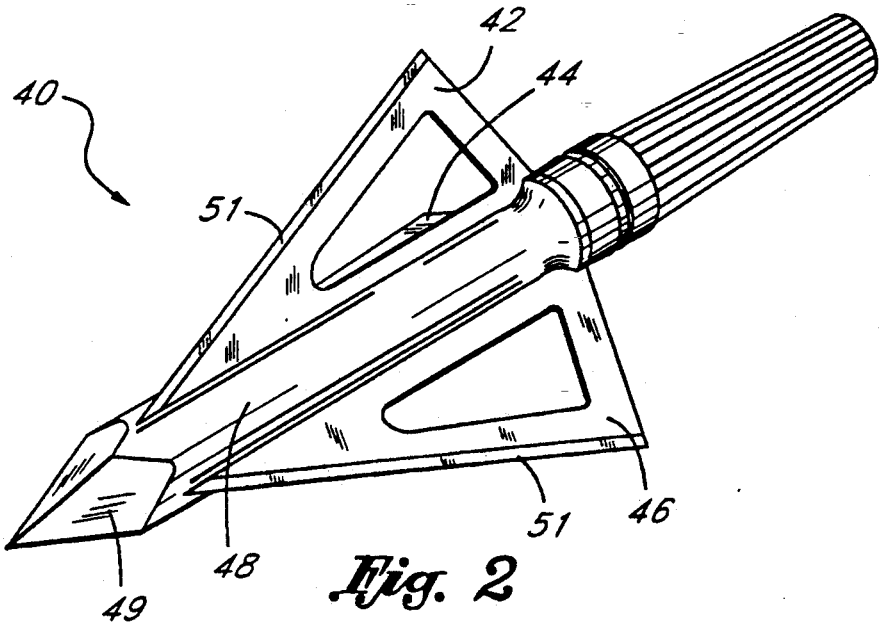
FIG. 2 is a perspective view of a broadhead arrow.

The top sharpening surface 12 is particularly suited to sharpen a broadhead arrow 40 of the type shown in FIG. 2. The broadhead 40 comprises three blades 42, 44, 46 evenly spaced approximately 120 degrees apart which extend radially outward from a ferrule 48. The ferrule 48 is generally cylindrical and extends outwardly at one end into a pointed tip 49. Each blade 42, 44, 46 of the arrow 40 is beveled at the outer edge, opposite the ferrule 48, to form a cutting edge generally designated 51, which contacts the sharpening surface 12 as the blade 40 is sharpened.

As illustrated in FIG. 3, the broadhead arrow 40 having three blades 42, 44, 46, can be sharpened on the top sharpening surface 12. The broadhead 40 is positioned on the sharpening surface 12 such that two of the blades 44, 46 are positioned on top of the sharpening sections 18, 20 and the other blade 42 extends upwards. A broadhead 50 with two blades can be sharpened on the bottom sharpening surface 14. In addition, a broadhead having four blades (not shown) can be advantageously sharpened on the bottom sharpening surface 14. The broadhead 50 illustrated comprises two cutting blades 54, 56 and two auxiliary blades 52, 58 which are evenly spaced and extend radially outward from a ferrule 60. The broadhead 50 is disposed such that the two cutting blades 54, 56 are in contact with the sharpening surface 14. The auxiliary blades 52, 58 are positioned as shown, with one auxiliary blade 52 extending upwards into the space between the top and bottom sharpening surfaces 12, 14 and the other auxiliary blade 58 extending downward into the channel 28 formed between the two bottom sections 24, 26.

FIG. 4 illustrates the sharpening process for the broadhead arrow 40 having three blades. As described above, the broadhead 40 is positioned so that two blades 44, 46 are in contact with the sharpening surface 12. When the blade 44 is in contact with the sharpening section 18, the opposing sharpening section 20 acts as a guide surface for the blade 20. Similarly, the sharpening section 18 provides a guide surface for the blade 44 as the blade 46 is sharpened on the opposing section 20. As the broadhead 40 is moved back and forth on the surface 12 in the direction of the transverse axis 19, the blades 44, 46 come in contact with the diamond pads and are subsequently sharpened. The cutting edge 51, of the blades 44, 46 contact the surface 12 at a single line of contact, generally designated 70. As illustrated, the surface 12 has a longitudinal axis 21 which is substantially longer than the transverse axis 19. The short length of the transverse axis is a direct consequence of the curvature of the surface 12 and advantageously allows the line of contact 70 formed between the arrow 40 and the surface 12 to travel over the surface 12 as will be explained hereinafter. The sharpening process for the broadhead 50 is conducted in a similar manner along the bottom sharpening surface 14.

Referring to FIG. 5 and FIG. 6, each blade 44, 46 touches the respective sharpening section 18, 20 at a single line of contact at any given time. As shown, the blade 46 only contacts the sharpening section 20 along the cutting edge 51 at the line of contact 70. The sharpening section 20 is curved about an axis 72 which is into the page in FIG. 6. The blade 46 travels in a direction indicated by the arrow 74 during the sharpening process. The axis of curvature 72 is at right angles, i.e., perpendicular, to the direction of travel 74. Similarly, the sharpening sections 18, 24, 26 are curved about an axis perpendicular to the direction of blade travel. Because the sharpening section 20 is curved, all other points along the cutting edge 51 of the blade 46 are not in contact with the sharpening section 20 for that particular time. In a similar manner, the cutting edge 51 of the blade 44 only contacts the sharpening section 18 at line of contact. Thus, at any particular moment in time, a single line of contact is formed between the broadhead 40 and the sharpening surface 12. This ensures that each blade 44, 46 is sharpened evenly by allowing sharpening of the whole blade, including the higher points along the beveled cutting edge 51 of the blades 44, 46. Furthermore, as each blade 44, 46 is moved back and forth across the sharpening surface 12 the line of contact will change depending upon the angle of the blade 44, 46 with respect to the sharpening section 18, 20 and the position of the blade on the corresponding sharpening section 18, 20. Consequently, the line of contact formed is free to move across the entire sharpening surface 12, reducing wear on the surface and increasing durability and longevity of the sharpener.

The process described above is identical for the broadhead arrow 50 described in connection with FIG. 3. Each cutting blade 54, 56 of the broadhead 50 contacts the respective sharpening section 24, 26 at one line of contact such that a single line of contact is formed between the sharpening surface 14 and the broadhead 50 for any given time. Since only one line of contact is formed between each blade 54, 56 and the sharpening surface 14, the force applied to the blades 54, 56 is not distributed along other points on the cutting edge of the blade 54, 56. Instead, the applied force is focussed on each line of contact of each blade 54, 56 such that as each blade 54, 56 is moved across the sharpening sections 24, 26, all points are evenly sharpened. Again, the line of contact formed between the blades 54, 56 and the sections 24, 26 comprising the surface 14 is free to move along the surface 14 in response to changes in angle and position between the broadhead 50 and the surface 14. Because the line of contact can be varied, the wear on the sharpening surface 14 is distributed across the surface 14 and the durability and longevity are advantageously increased.

The curved sharpening surfaces 12, 14 further increase the ability to put pressure on a single line of contact and, as a result, the blades 44, 46, 54, 56 can be sharpened faster than with conventional sharpening devices. Since the pressure is focussed on the blades 44, 46, 54, 56 along the single line of contact, less pressure is required to sharpen the blades. The diamond pads advantageously act to remove less metal when less pressure is applied, and thus, less metal is removed when the blades 44, 46, 54, 56 are sharpened, resulting in a finer edge and longer blade life than can be realized with other abrasive surfaces.

With reference to the foregoing description, the sharpener of the present invention can advantageously be utilized to sharpen deformed broadhead blades, such as warped or bent blades. As illustrated and explained above, the sharpener is short and curved about an axis perpendicular to the direction of sharpening motion so that the cutting edge of the blade contacts the sharpening surface at a single line of contact. Thus, any warped or bent area of the blade will still be able to contact the sharpening surface and will subsequently be sharpened. In addition, curved or serrated blades can be sharpened along a single line of contact. This offers a significant advantage over conventional sharpeners having flat surfaces which establish contact with a substantial amount of the length of the blade. In these types of sharpening devices, a warped or bent area on the cutting edge will not come in contact with the sharpening surface, and even sharpening of the blade is not achieved.

Although the sharpening device of the present invention has been described in terms of broadhead arrows having three and four blades, one skilled in the art will recognize that a variety of broadhead arrows having a plurality of blades can be effectively and evenly sharpened on the curved sharpening surfaces 12, 14 illustrated. In addition, the sharpener is not limited to sharpening broadhead arrows. A variety of cutting elements, including fishhooks and knives, can be sharpened on the cylindrical sharpening surface 16.

I claim:

1. A combination of a sharpener and a broadhead arrow having a plurality of broadhead blades comprising:

a broadhead arrow having at least three blades radiating from a central arrow axis, each of said blades including a cutting edge directed away from said central arrow axis; and a sharpener, comprising:

a first sharpening surface having a single convex curved surface with a radius of curvature over a portion thereof defining a first axis, said first sharpening surface positioned in contact with said cutting edge of a first of said blades, and a second sharpening surface having a single convex curved surface with a radius of curvature over a portion thereof defining a second axis, said second sharpening surface positioned in contact with said cutting edge of a second of said blades, said first and second sharpening surfaces arranged such that they are symmetrical about a plane located between said sharpening surfaces wherein said first and second axes intersect said plane.

2. The combination of a sharpener and a broadhead arrow as defined in claim 1, further comprising an opening formed between said first and second sharpening surfaces to accommodate placement of said arrow between said first and second sharpening surfaces.

3. The sharpener as defined in claim 1, wherein said sharpener further comprises a cylindrical sharpening surface adapted to sharpen discrete cutting elements.

4. The combination of a sharpener and a broadhead arrow as defined in claim 1, wherein at least one of said first and second sharpening surfaces comprises a diamond pad.

5. A combination of a sharpener adapted for sharpening a broadhead arrow having discrete cutting elements by reciprocating said arrow along a direction of travel, and a broadhead arrow, said combination comprising:

a broadhead arrow having at least three blades radiating from a central arrow axis, each of said blades including a cutting edge directed away from said central arrow axis; and a sharpener, comprising:

a frame;

a first sharpening surface mounted on said frame, said first sharpening surface comprising a first pair of sharpening sections angularly disposed relative one another, each of said sections curved about an axis perpendicular to said direction of travel of said broadhead arrow, one of said first pair of sharpening sections contacting a first of said blades of said broadhead arrow and the other of said first pair of sharpening sections contacting a second of said blades of said broadhead arrow; and a second sharpening surface mounted on said frame, said second sharpening surface comprising a second pair of sharpening sections angularly disposed relative one another, each of said sections curved about an axis perpendicular to said direction of travel of said broadhead arrow.

6. The combination of a sharpener and a broadhead arrow as defined in claim 5, wherein said second pair of sharpening sections is separated by an opening.

7. The combination of a sharpener and a broadhead arrow as defined in claim 5, wherein said second pair of sharpening sections is separated by an opening.

8. The combination of a sharpener and a broadhead arrow as defined in claim 5, further including a third cylindrical sharpening surface mounted to said frame.

9. The combination of a sharpener and a broadhead arrow as defined in claim 5, wherein said first pair of sharpening sections is angled downwardly and wherein said second pair of sharpening sections is angled upwardly.

10. The combination of a sharpener and a broadhead arrow as defined in claim 5, wherein at least one of said first and second pairs of sharpening sections comprises diamond pads.

11. The combination of a sharpener and a broadhead arrow as defined in claim 5, wherein said frame is formed of ABS plastic.

12. A sharpener adapted for sharpening broadhead arrows having a plurality of broadhead blades by reciprocating said blades along a direction of travel, said sharpener comprising:

a first sharpening surface, said first sharpening surface comprising two sharpening sections separated by a slot adapted to accommodate placement of one of said arrows, wherein said sharpening sections are curved about an axis perpendicular to the direction of travel of said blades and separated angularly from one another by more than 180 degrees; and a second sharpening surface, said second sharpening surface comprising two sharpening sections separated by a channel adapted to accommodate placement of a second of said arrows, wherein said sharpening sections are curved about an axis perpendicular to the direction of travel of said blades and separated angularly from one another by less than 180 degrees.

13. The sharpener as defined in claim 12, wherein said sharpening sections comprising said first and second sharpening surfaces are angularly disposed relative one another.

14. The sharpener as defined in claim 12, wherein at least one said sections comprising said first and second sharpening surfaces is covered with diamond pads.

15. A method for sharpening a broadhead arrow having a plurality of blades by reciprocating said blades along a direction of travel comprising the steps of:

placing a first of said broadhead blades on a sharpening surface curved about an axis perpendicular to said direction of travel such that said first blade forms only a single line of contact with said sharpening surface;

placing a second of said blades on an adjacent guide surface curved about an axis perpendicular to said direction of travel; and moving said arrow such that said first blade is moved across said sharpening surface along said direction of travel such that all points along said blade are evenly sharpened.

16. A method of sharpening a broadhead arrow having a plurality of blades by reciprocating said blades along a direction of travel, wherein at least one of said blades comprises a deformed region, comprising the steps of:

placing said blade having said deformed region on a sharpening surface, said sharpening surface curved about an axis perpendicular to the direction of sharpening motion of said blade such that said blade contacts said surface at a single line of contact on said surface;

placing a second of said blades on an adjacent curved guide surface; and moving said blade across said sharpening surface such that said deformed region of said blade is sharpened.

17. A combination of a sharpener and a broadhead arrow having a plurality of broadhead blades comprising:

a broadhead arrow having at least three blades radiating from a central arrow axis, each of said blades including a cutting edge directed away from said central arrow axis; and a sharpener, comprising:

a sharpening surface in contact with said cutting edge of a first of said blades, and having a single convex surface with a radius of curvature over a portion thereof defining a first axis; and a guide surface in contact with said cutting edge of a second of said blades, and having a single convex surface with a radius of curvature over a portion thereof defining a second axis, said sharpening surface and said guide surface arranged such that they are symmetrical about a plane located between said surfaces wherein said first and second axes intersect said plane, each of said first and second axes being perpendicular to said arrow axis.

* * * * *

UNITED STATES PATENT AND TRADEMARK OFFICE

CERTIFICATE OF CORRECTION

PATENT NO. : 5,157,879

DATED : October 27, 1992

INVENTOR(S) : William J. Fletcher

It is certified that error appears in the above-indentified patent and that said Letters Patent is hereby corrected as shown below:

In Column 1, at line 59, change "preset" to --present--.

In Column 2, at line 34, change "U.S. Pat. No." to --No.--.

In Column 5, at line 36, change "The sharpener as" to --The combination of a sharpener and a broadhead arrow as--.

In Column 6, at line 4, change "wherein said second pair" to --wherein said first pair--.

In Column 6, at line 49, change "one said" to --one of said--.

Signed and Sealed this

Twenty-fifth Day of January, 1994

*Attest:*

Bruce Lehman

BRUCE LEHMAN

*Attesting Officer*

*Commissioner of Patents and Trademarks*